US011630421B2

(12) United States Patent
Jung et al.

(10) Patent No.: US 11,630,421 B2
(45) Date of Patent: Apr. 18, 2023

(54) TIMEPIECE STRIKING MECHANISM

(71) Applicant: Montres Breguet S.A., L'Abbaye (CH)

(72) Inventors: Marc Jung, Bellefontaine (FR); Marc Abt, Fuans (FR); Marc Stranczl, Nyon (CH); Benoit Legeret, Ecublens (CH)

(73) Assignee: Montres Breguet S.A., L'Abbaye (CH)

( * ) Notice: Subject to any disclaimer, the term of this patent is extended or adjusted under 35 U.S.C. 154(b) by 926 days.

(21) Appl. No.: 16/357,454

(22) Filed: Mar. 19, 2019

(65) Prior Publication Data

US 2019/0294116 A1 Sep. 26, 2019

(30) Foreign Application Priority Data

Mar. 21, 2018 (EP) ..... 18163140

(51) Int. Cl.
*G04B 23/02* (2006.01)
*G04B 21/06* (2006.01)

(52) U.S. Cl.
CPC ..... *G04B 23/026* (2013.01); *G04B 21/06* (2013.01)

(58) Field of Classification Search
CPC ..... G04B 23/026; G04B 21/06
USPC ..... 368/243
See application file for complete search history.

(56) References Cited

U.S. PATENT DOCUMENTS

| | | | | |
|---|---|---|---|---|
| 4,036,005 | A | 7/1977 | Jauch | |
| 2012/0113767 | A1* | 5/2012 | Marechal | G04B 31/004 368/287 |
| 2012/0147715 | A1* | 6/2012 | Karapatis | G04B 23/028 368/267 |
| 2012/0155227 | A1* | 6/2012 | Karapatis | G04B 23/026 368/243 |

(Continued)

FOREIGN PATENT DOCUMENTS

| | | |
|---|---|---|
| DE | 952 066 | 11/1956 |
| DE | 1 215 600 | 4/1966 |

(Continued)

OTHER PUBLICATIONS

Combined Chinese Office Action and Search Report dated Jul. 28, 2020 in corresponding Chinese Patent Application No. 201910212877.X (with English Translation and English Translation of Category of Documents), 15 pages.

(Continued)

*Primary Examiner* — Edwin A. Leon
*Assistant Examiner* — Kevin Andrew Johnston
(74) *Attorney, Agent, or Firm* — Oblon, McClelland, Maier & Neustadt, L.L.P.

(57) ABSTRACT

A timepiece striking mechanism including a mechanism for controlling a hammer arranged to strike a resonant component in an impact position, and movable within a working zone between a recoil and rest position and this impact position, this mechanism includes a device for limiting recoil of the hammer after impact, formed either by eddy (Continued)

current braking means arranged to brake the hammer when it enters a back zone, connected and contiguous to the working zone and opposite the impact position, and/or by mechanical friction and/or elastic return means integral with the hammer or an anchor-piece integral with the hammer, and arranged for friction and/or abutting engagement with a moving braking component or a surface of a fixed part of the striking mechanism.

8 Claims, 3 Drawing Sheets

(56) References Cited

U.S. PATENT DOCUMENTS

2012/0201105 A1 8/2012 Chatelain et al.
2012/0207001 A1* 8/2012 Pittet ..... G05D 13/24 368/243
2016/0299472 A1* 10/2016 Legeret ..... G04B 23/023
2017/0176938 A1 6/2017 Alagon Carrillo et al.

FOREIGN PATENT DOCUMENTS

| | | |
|---|---|---|
| EP | 2 048 548 A2 | 4/2009 |
| EP | 2 485 098 A1 | 8/2012 |
| EP | 3 079 024 A1 | 10/2016 |
| FR | 918.845 | 2/1947 |
| FR | 1.157.179 | 5/1958 |
| FR | 1.214.428 | 4/1960 |
| JP | 3-125395 U | 12/1991 |

OTHER PUBLICATIONS

European Search Report dated Dec. 13, 2018 in European Application 18163140.9 filed on Mar. 21, 2018 (with English translation of categories of Documents).

* cited by examiner

TIMEPIECE STRIKING MECHANISM

CROSS-REFERENCE TO RELATED APPLICATION

This application claims priority to European Patent Application No. 18163140.9 filed on Mar. 21, 2018, the entire disclosure of which is hereby incorporated herein by reference.

FIELD OF THE INVENTION

The invention concerns a timepiece striking mechanism comprising a fixed part and a control mechanism arranged to directly or indirectly control the motion of at least one hammer, this hammer including a striking area arranged to strike at least one resonant component or a gong or a disc-gong, said at least one hammer being movable within a working zone between a recoil and rest position and an impact position where the striking area engages with at least one resonant component.

The invention also concerns a timepiece mechanism including such a striking mechanism.

The invention also concerns a timepiece including such a timepiece mechanism, and/or such a striking mechanism.

The invention concerns the field of sound emitting timepiece mechanisms, such as striking or alarm mechanisms, musical boxes and suchlike.

BACKGROUND OF THE INVENTION

Timepiece striking or alarm mechanisms generally comprise a hammer, which strikes a gong or suchlike.

The rebound of the hammer, when it returns after striking the gong, can produce unwanted noise, particularly if the hammer strikes a fixed element, such as a plate, during its return travel. Consequently, the sound produced by the striking or alarm mechanism is neither elegant nor controlled. Further, certain components may be damaged by the hammer recoil.

French Patent Publication No. FR1157179A in the name of JAZ describes a progressive alarm mechanism. In a variant, the recoil motion of the hammer is braked by a high inertia device. In a variant, the slower the motion transmitted to the high inertia device, the higher the braking will be. In a variant, the motion is transmitted to the high inertia device by impulses provided by the hammer during its recoil motion. In a variant, the high inertia device is formed by a gear train that ends in a flywheel and is struck by the hammer by means of a unidirectional driver. In a variant, an auxiliary device (for example of the brake pad type) brakes the flywheel between each of the impulses provided by the hammer. In a variant, the unidirectional driver (for example of the click type) can be disengaged by retracting the click. In a variant, the click is retracted by a cam connected to the barrel arbor of the striking work.

DE Patent Publication No 952066C in the name of JUNGHANS discloses an alarm mechanism with an impact sequence initially stretched out by a damping device, which includes a flexible elastic body able to be deformed during the back and forth motion of a moving alarm component, and which returns to position at least after the second half of the vibration.

US Patent Publication No 4036005A in the name of JAUCH discloses a clock with a mechanism for producing a two-note tone at the quarter hour, two two-note tones at the half hour, three two-note tones at the three-quarter hour, and, on the hour, a tone corresponding to the hour indicated. A latch and rack structure controls the number of strikes at the quarter hours, and a rack and a snail cam control the number of strikes on the hour.

FR Patent Publication No 918845A in the name of Compagnie Industrielle de Mécanique Horlogère discloses an alarm mechanism. In a variant, the alarm sound starts at a slow, regular pace, then becomes progressively faster and faster paced and finishes at a regular fast pace. In a variant, the striking mechanism sounds successive series of strokes; the number of strokes in these series progressively increases; the intervals between the series progressively decrease and the alarm sound finishes at a regular fast pace. In a variant, the striking mechanism starts with strokes that are spaced apart; the intervals between these strokes progressively decrease and the alarm sound finishes at a regular fast pace.

European Patent Publication No EP2048548A2 in the name of RICHEMONT discloses a strike hammer, which includes a first part and a second part which are articulated to one another, and an elastic member fixed to one of these two parts, such that the two parts can move relative to one another between a first stable hammer configuration, in which they are retained by means of the elastic member, and a second hammer configuration, in which they are moved against the action of the elastic member.

European Patent Publication No EP24850098A1 in the name of MONTRES TUDOR disclose a striking mechanism which includes a drive member kinematically connected to a strike wheel, a strike hammer, an anchor-piece comprising two arms alternately meshing with the strike wheel and engaging with the strike hammer to oscillate said hammer between a first position of impact on a resonant member and a second position, and a banking spring defining the second position. The anchor-piece and the strike hammer form a single strike member mounted to pivot on the frame.

SUMMARY OF THE INVENTION

The invention proposes to limit hammer rebound.

To this end, the invention concerns a striking mechanism.

The invention also concerns a timepiece mechanism including such a striking mechanism.

The invention also concerns a timepiece, especially a watch, including such a timepiece mechanism, and/or such a striking mechanism.

BRIEF DESCRIPTION OF THE DRAWINGS

Other features and advantages of the invention will appear upon reading the following detailed description, with reference to the annexed drawings, in which the Figures represent details of a striking mechanism according to the invention, illustrating different variants for braking a strike hammer as it recoils after impact.

DETAILED DESCRIPTION OF PREFERRED EMBODIMENTS

Figure 1:
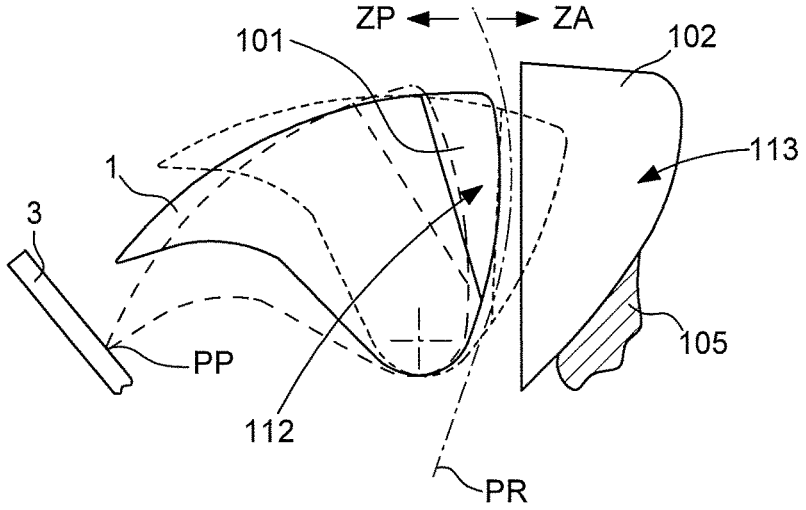
FIG. 1 represents a schematic plan view of a first variant wherein the hammer recoil is braked by eddy currents induced during the recoil between a back part of the hammer and a stator.

The invention proposes to limit hammer rebound. This means here the main rebound, i.e. from the large amplitude recoil of the hammer after impact and not the micro-rebounds which are also related to vibration of the gong.

The invention concerns a timepiece striking mechanism 100 comprising a fixed part 105, and a control mechanism arranged to directly or indirectly control the motion of at least one hammer 1. The control mechanism more particularly but not exclusively comprises a control wheel set 10. EP Patent Application No 3079024 by the same Applicant describes the operation of a magnetic actuator for a strike hammer, which may be suitable for the invention, to activate or release the strike of a hammer on a gong.

A 'striking mechanism' means, in the broad sense, any timepiece mechanism emitting a sound: a striking or alarm mechanism, musical box, or otherwise.

Such a hammer 1 includes a strike area 2 arranged to strike at least one resonant component 3 or a gong or a disc-gong. This first resonant component 3 is illustrated in a non-limiting manner in the Figures, in the usual form of a gong. It may also consist of a disc-gong, a bell, a comb, or otherwise.

This at least one hammer 1 can move within a working zone ZP between a recoil and rest position PR and an impact position PP where striking area 2 engages with at least one resonant component 3.

According to the invention, mechanism 100 includes means for limiting the recoil of each hammer 1 after impact.

These means for limiting the recoil of each hammer 1 after impact can take different forms, and must be designed to use, during recoil, extra energy related to rebound on the gong, and also to avoid excessive energy consumption during control of a strike, or to store energy in the recoil and rest position PR and restore it during the next strike function.

These hammer recoil limiting means may, in particular but not exclusively, comprise:

eddy current braking means which are arranged to brake hammer 1 when it enters a back zone ZA, connected and contiguous to working zone ZP in recoil and rest position PR and extending opposite impact position PP relative to recoil and rest position PR;

and/or magnetic or magnetic repulsion braking means;

and/or mechanical friction and/or damping means, and/or elastic return means integral with hammer 1 or an anchor-piece 11 integral with hammer 1, and arranged for friction or abutting engagement with a moving braking component or a surface of a fixed part of the striking mechanism.

In the case of braking by means of eddy currents or magnetic interaction, this hammer 1, or anchor-piece 11 integral with this hammer 1, includes a first surface 112 which is arranged to engage, either with at least one stator 102 or at least one pole piece 103 in a back zone ZA, connected and contiguous to working zone ZP in recoil and rest position PR and extending opposite impact position PP, in order to brake first surface 112.

Braking can be achieved by various means, which are cumulative: using eddy currents or magnetic repulsion when first surface 112 enters back zone ZA, or magnetic and/or mechanical driving with at least one moving component 7, which is comprised in striking mechanism 100 and directly or indirectly carried by fixed part 105, or by a structure 50 to which the striking mechanism is fixed, in order to brake first surface 112 by friction or shock absorption or elastic repulsion.

The variants that implement eddy currents or slow shock absorption have the advantage of not restoring energy instantaneously and are particularly advantageous for the hammer recoil damping function.

In the alternative implementing eddy currents, first surface 112 is arranged to cooperate with at least one stator 102 in back zone ZA. Hammer 1, or anchor-piece 11 integral with hammer 1, includes at least a first surface 112, which is magnetized or conductive, movable parallel to a second conductive or magnetized surface 113 comprised in a stator 102, which may be such a moving component 7, or a surface of a fixed part 10, or of a structure 50 to which striking mechanism 100 is fixed, for eddy current braking of hammer 1 during its recoil, when hammer 1 enters back zone ZA. FIG. 1 illustrates such a configuration, first surface 112 is on a back part 101 of hammer 1, and second surface 113 is a surface of a stator 102, here, in a non-limiting manner integral with fixed part 105; when hammer 1, during its recoil, crosses the boundary PR between working zone ZP and back zone ZA, first surface 112 and second surface 113 of stator 102 move progressively further and further on top of each other, generating induced eddy currents that increase with the recoil of hammer 1.

More particularly, the position and/or angular orientation of at least one such stator 102 is adjustable, to modify the intensity of its eddy current interaction with first surface 112.

Figure 2:
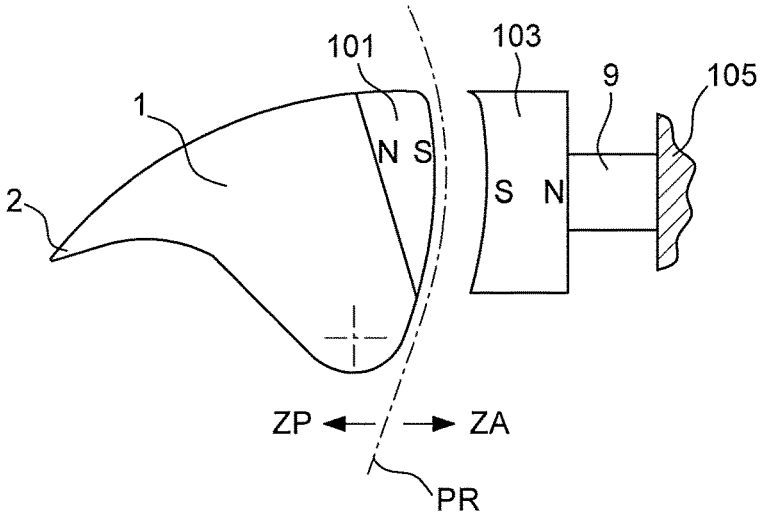
FIG. 2 shows, in a similar manner to FIG. 1, a magnetic variant combined with a shock absorber.

In a magnetic alternative, the hammer recoil limiting means are, as seen in FIG. 2, magnetic repulsion means. Hammer 1 includes here, in a non-limiting manner, a back part 101, which is then magnetized with the same polarity as another pole piece 103, which is a magnet fixed on a fixed part 105 or on a shock absorber 9, or which is a magnetized area of a fixed part 105 or of a shock absorber 9. Such a shock absorber 9 can comprise at least one spring, and/or preferably at least one anti-shock device, for example of the viscous friction type with damping means, which include a compressible fluid between a pole piece and a stop, or a shape memory deformable shock absorber to dissipate the kinetic energy of a shock, and to slowly return to its initial shape after a shock, made, for example, of neoprene or suchlike. Such a shock absorber 9 is described in EP Patent Application No 2450759 by the same Applicant for the anti-shock function of an arbor with magnetic pivots.

Another magnetic braking variant consists in producing a similar configuration to that of FIG. 1, with a first surface 112 and a second surface 113 which are both magnetized, so as to create an oblique resultant force from the inertia force and from the force of magnetic origin which is perpendicular thereto, and whose intensity increases as back part 101 moves under second surface 113. First surface 112 is arranged in such case to cooperate with at least one such pole piece 103, which belongs to a moving component 7 or which is a portion of fixed part 105, in back zone ZA, in order to brake first surface 112 by magnetic repulsion when first surface 112 enters back zone ZA. More particularly, at least one such pole piece 103 is a part of such a moving brake component 7. More particularly, the position and/or angular orientation of at least one pole piece 103 is adjustable, to modify its magnetic interaction with first surface 112.

In a friction braking variant, first surface 112 includes at least one friction surface 111, which is arranged for friction cooperation with a complementary surface comprised in a moving brake component 7, or with a complementary friction surface comprised in fixed part 105, or comprised in a fixed structure 50 to which striking mechanism 100 is fixed, for friction braking of hammer 1 during its recoil.

In a damping variant, mechanism 100 includes damping means including at least one shape memory deformable shock absorber 9, as described above, inserted on the trajectory of one end of hammer 1 or of anchor-piece 11 integral with hammer 1, arranged to dissipate shock kinetic energy, and to slowly return to its initial shape after a shock.

In a variant where anchor-piece 11 is not integral in rotation with hammer 1, but designed like a lathe dog, simply to move it into the impact position, such recoil limiting means can also be arranged at the interface between hammer 1 and anchor-piece 11.

Figure 3:
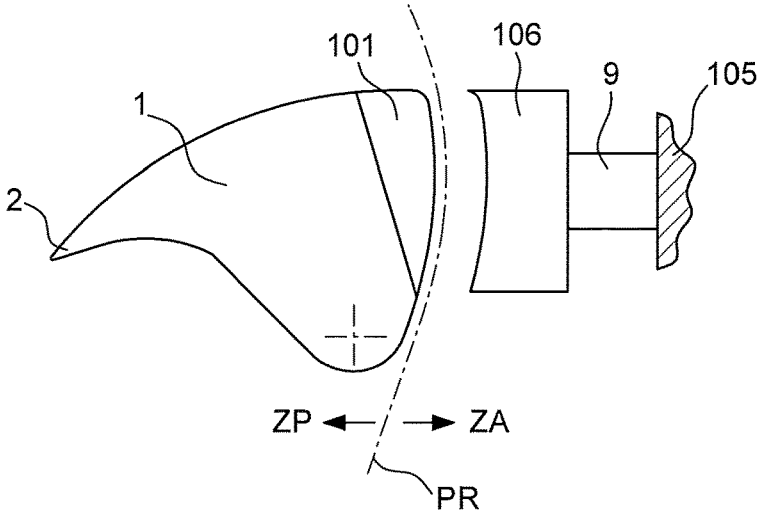
FIG. 3 represents, in a similar manner to FIG. 2, a mechanical variant combined with a shock absorber.

Naturally, hammer 1 can also simply strike, during its recoil, a simple weight 106 suspended on a fixed part 105 by a shock absorber spring 9 or with an anti shock device, as seen in FIG. 3. In a particular embodiment, such an anti-shock device may include both damping means and elastic return means, which are distinguished by their time constant, the return to a position of stable equilibrium being slower with damping means than with elastic return means. Thus, the variant with slow return damping is generally more advantageous than that having only conventional elastic return means. Even if the damping means has a return-to-position time of around a second, this is still compatible with application to a repeater mechanism or to a music box.

In one or other of the illustrated variants, hammer 1 or anchor-piece 11 integral with hammer 1, may include, on first surface 112, at least one bearing surface 6 arranged for abutting engagement with a moving brake component 7, comprised in striking mechanism 100, for impulse and/or friction driving, to ensure braking of hammer 1, or for direct or indirect abutting engagement with a stop surface of fixed part 105, or of a fixed structure 50 to which striking mechanism 100 is fixed.

More particularly, the recoil limiting means for hammer 1 thus include mechanical means of elastic return 4, which are integral with one end of hammer 1, or of anchor-piece 11 integral with hammer 1. These mechanical means of elastic return are mounted in a cantilever arrangement and are arranged for abutting engagement with a moving brake component 7 or a stop surface of a fixed part 105 of striking mechanism 100, or of structure 50, or of a stop 51 suspended to such a fixed part 105 or structure 50 by a shock absorber 9, also including at least one spring and/or one anti-shock device.

In particular, hammer 1 or anchor-piece 11 include, on first surface 112, at least one banking spring 4 which includes at least one distal bearing surface 6 arranged for abutting engagement with such a moving brake component 7, for impulse and/or friction driving thereof, to ensure braking of hammer 1 to which banking spring 4 is fixed, or for direct or indirect abutting engagement with a stop surface of fixed part 105, or of a fixed structure 50 to which striking mechanism 100 is fixed. FIGS. 4, 5, 6 and 9, show at least one such banking spring 4, which is arranged to define the recoil and rest position. This at least one banking spring 4 is fixed, either to a hammer 1, particularly but not exclusively in a back area 5 opposite striking area 2 (an embodiment with a spring on the impact side can also be envisaged), or to anchor-piece 11 integral with hammer 1, and it includes at least one distal bearing surface 6, which is arranged for abutting engagement with a moving component 7 or 51 comprised in striking mechanism 100, and/or for direct or indirect abutting engagement with a fixed part 105 or to a fixed structure 50 comprised in striking mechanism 100 or to which striking mechanism 100 is fixed.

More particularly, this bearing surface 6 is arranged for abutting engagement with a moving component 7 comprised in striking mechanism 100, such as a wheel, an inertia wheel set, or a friction braked wheel set, and for impulse driving thereof, particularly pivoting, and/or friction driving to ensure braking of hammer 1 to which banking spring 4 is fixed. More particularly, this moving component 7 includes a wheel or a ratchet able to drive a flywheel 71 or to form a flywheel.

This type of moving inertia component 7 can also be actuated by the hammer in its magnetic variant, wherein moving, particularly rotating component 7, carries, for example, a plurality of pole pieces 103.

More particularly, moving component 7 is free in rotation, and, in a variant is braked by friction.

Figure 7:
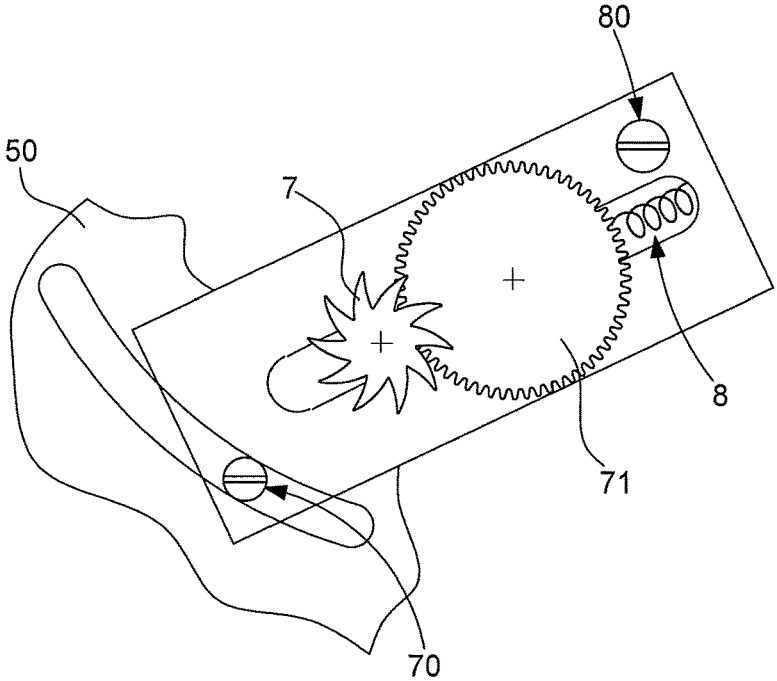
FIG. 7 represents, in a similar manner to FIG. 5, a detail of a variant with damping means for the assembly formed by the wheel and the flywheel, and means for adjusting the position of this assembly, and means for adjusting these damping means.

In a variant, as seen in FIG. 7, bearing surface 6 is arranged to push moving component 7 against first elastic return means 8, which are arranged to resist the recoil of hammer 1 to which banking spring 4 is fixed.

More particularly, striking mechanism 100 includes first adjustment means 70, for adjusting the rest position or moving component 7 and/or the angular position of moving component 7 in its rest position, as seen in FIG. 7.

Figure 8:
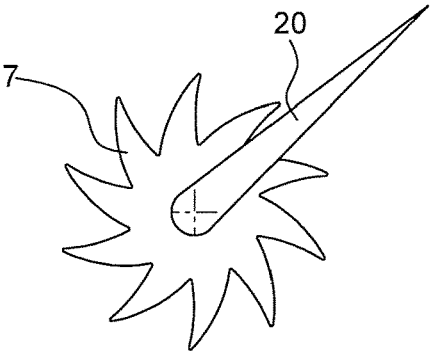
FIG. 8 represents a detail of the wheel of FIG. 5 or 7 provided with a display member such as a hand.
Figure 10:
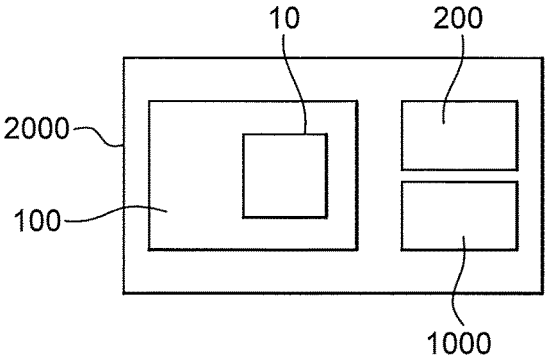
FIG. 10 is a block diagram representing a watch comprising a timepiece mechanism and a striking mechanism according to the invention.

In a particular variant, as seen in FIG. 8, moving component 7 is arranged to drive a display member 20 arranged to display the motion of hammer 1 to which banking spring 4 is fixed.

Figure 4:
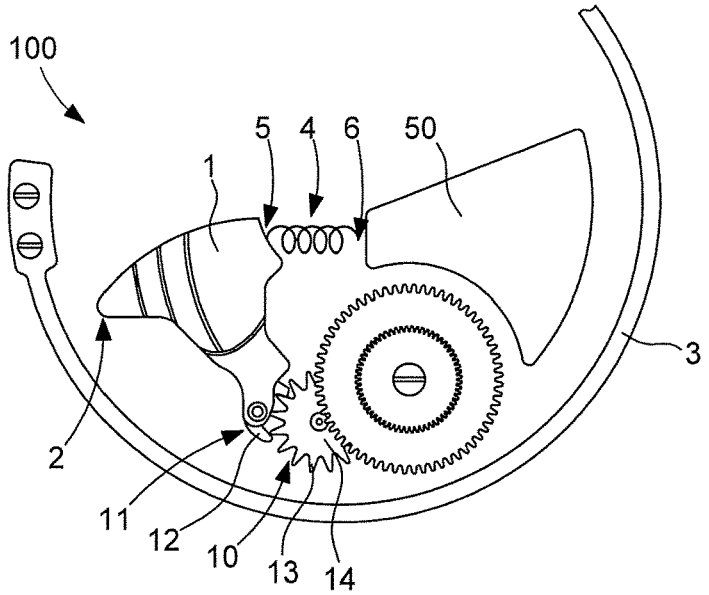
FIG. 4 represents, in a similar manner to FIG. 1, a variant with a spring fixed to the back part of the hammer and arranged to strike a fixed part of the mechanism.
Figure 9:
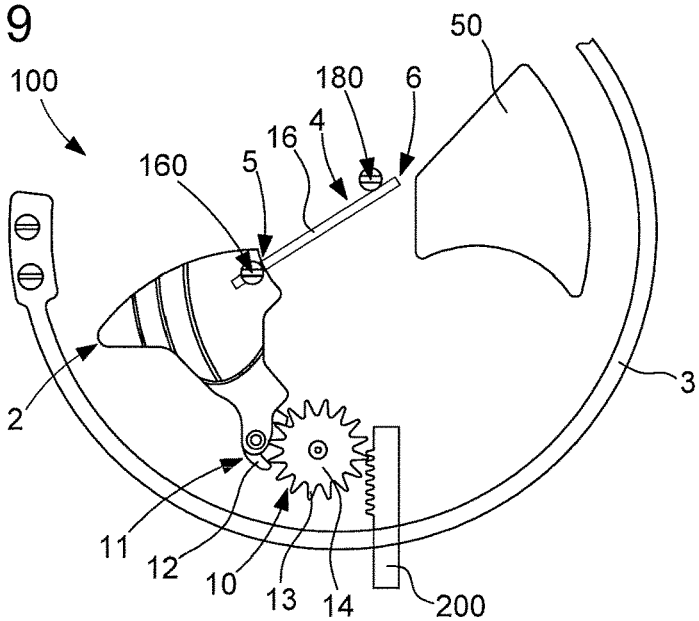
FIG. 9 represents, in a similar manner to FIG. 5, a variant with a strip spring, and means for adjusting the strip length, and means for adjusting orientation of the strip in the contact position.

In the simplest variant, as seen in FIG. 4 or FIG. 9, bearing surface 6 is arranged for direct abutting engagement with a fixed structure 50.

Figure 6:
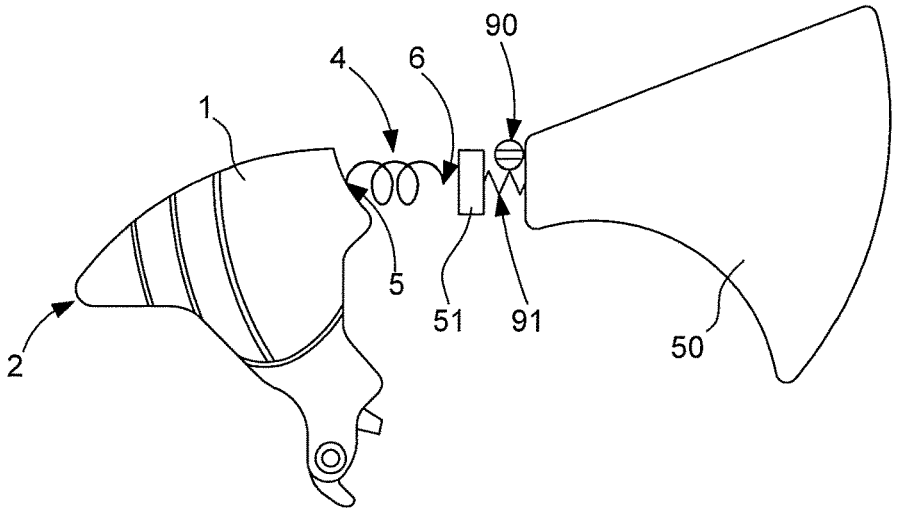
FIG. 6 represents, in a similar manner to FIG. 4, a variant with a spring fixed to the back part of the hammer and arranged to strike a stop suspended by a shock absorber including stiffness or position adjustment means.

In the variant of FIG. 6, support surface 6 is arranged for indirect abutting engagement with fixed part 105 or a fixed structure 50, through a suspended stop 51 and second elastic return means 91, which are arranged to resist the recoil of hammer 1 to which is fixed banking spring 4. More particularly, striking mechanism 100 in this case includes second means 90 for adjusting the position and/or stiffness of second elastic return means 91.

Generally, first surface 112 can be arranged to engage with at least one moving component 7 which includes a wheel or a ratchet arranged to drive a flywheel 71 or forming a flywheel.

More particularly, first surface 112 is arranged to cooperate with at least one moving component 7, and mechanism 100 includes first means 70 for adjusting the rest position of moving component 7 and/or the angular position of moving component 7 in its rest position.

Control wheel set 10 is more particularly arranged to control the movement of at least anchor-piece 11, which is in turn arranged to control a motion of at least one hammer 1 from its recoil and rest position to its impact position. More particularly, control wheel set 10 includes a wheel 14, and this at least anchor-piece 11 includes a plurality of beaks 12, each arranged to cooperate with one of teeth 13 comprised in wheel 14. More particularly still, according to a particular feature, the at least one anchor-piece 11 includes two beaks 12 alternatively meshing with wheel 14.

In a variant, this at least one anchor-piece 11 is at least pivotally joined to at least one hammer 1, in order to pivot with respect to fixed structure 50. More particularly, this at least one anchor-piece 11 is integral with at least one hammer 1.

Figure 5:
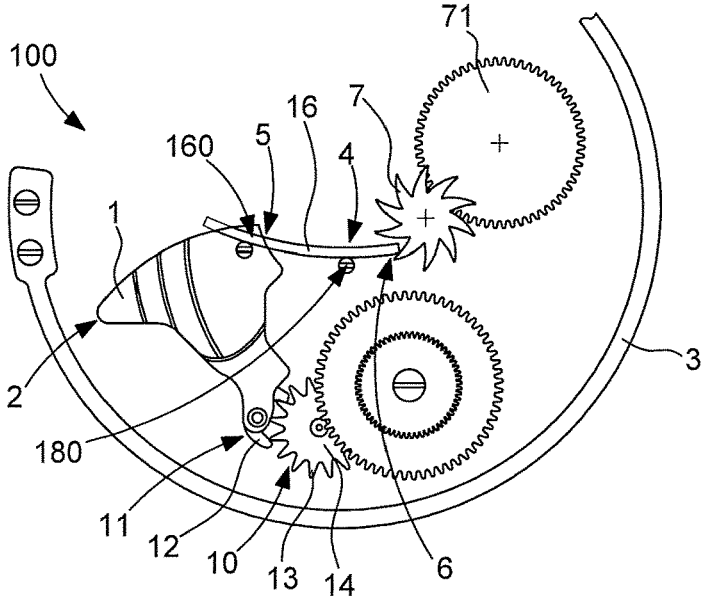
FIG. 5 represents, in a similar manner to FIG. 4, a variant with a strip spring fixed to the back part of the hammer and arranged to strike a wheel driving a flywheel.

As seen in the variants of FIGS. 5 and 9, at least one spring 4 for limiting the recoil and rest position of at least one hammer 1 includes a cantilevered strip 16 carrying at least one such bearing surface 6. More particularly, hammer 1, which carries strip 16 includes third adjustment means 160, which are arranged to modify the stiffness of strip 16 by modifying its vibrating length, and/or to modify the position and/or angular orientation of strip 16 during its abutting contact with a moving component 7 or with a fixed structure 50.

In the variant of FIG. 5, structure 50 includes fourth adjustment means 180, which are arranged to modify the stiffness of strip 16 by modifying its vibrating length, and/or to modify the angular orientation of strip 16 during its abutting contact with a moving component 7 or with a fixed structure 50.

In another embodiment, the means for limiting the recoil of hammer 1 are mechanical friction means, and hammer 1, or an anchor-piece 11 integral with hammer 1, includes at least one friction surface 111, which is arranged for friction cooperation with a moving braking component or a friction surface of a fixed part of striking mechanism 100, when hammer 1 enters the back zone.

The invention concerns a timepiece mechanism 2000 including such a striking mechanism 100, and an actuator 200, operable by a user to drive a control wheel set 10 comprised in striking mechanism 100, and/or a timepiece movement 1000 able to drive control wheel set 10.

The invention also concerns a timepiece 3000, particularly a watch, including such a timepiece mechanism 2000, and/or such a striking mechanism 100.

The invention claimed is:

1. A timepiece striking mechanism comprising:

a fixed part; and a control mechanism arranged to directly or indirectly control the motion of at least one hammer including a striking area arranged to strike at least one resonant component or a gong or a disc-gong in a front impact position, said at least one hammer being movable within a working zone between a recoil and rest back position and said front impact position, the control mechanism is arranged to limit the recoil of each said hammer by braking said hammer after impact, wherein said hammer or an anchor-piece integral with said hammer includes a first surface that is arranged to engage with at least one stator in a back zone, connected and contiguous to said working zone in said recoil and rest position and extending opposite said front impact position with respect to said recoil and rest position, in order to brake said first surface by eddy currents when said first surface enters said back zone, and wherein said first surface is conductive, and movable parallel to a second, respectively conductive surface comprised in said stator, which is a moving component, or which is a surface of said fixed part, in order to brake said hammer by eddy currents during its recoil.

2. A striking mechanism according to claim 1, wherein the position and/or angular orientation of at least one said stator is adjustable, to modify the intensity of the eddy current interaction thereof with said first surface.

3. A striking mechanism according to claim 1, wherein said first surface is arranged for magnetic drive engagement with at least one moving component, comprised in said striking mechanism and which is directly or indirectly carried by said fixed part, or by a structure to which said striking mechanism is fixed, in order to brake said first surface by damping.

4. A striking mechanism according to claim 1, wherein said first mechanism comprises damping means including at least one deformable shape memory shock absorber, inserted on the trajectory of one end of said hammer or of said anchor-piece integral with said hammer, arranged to dissipate shock kinetic energy, and to return slowly to its initial shape after a shock.

5. A striking mechanism according to claim 1, wherein said mechanism comprises first means for adjusting the rest position of said moving component and or the angular position of said moving component in its rest position.

6. A striking mechanism according to claim 1, wherein said first surface is located on a back part of said hammer in a back zone opposite to said striking area.

7. A timepiece mechanism comprising a striking mechanism according to claim 1, and an actuator able to be operated by a user to drive a control wheel set comprised in said mechanism, and/or a timepiece movement able to drive said control wheel set.

8. A timepiece comprising:

the timepiece mechanism according to claim 7.

* * * * *